United States Patent [19]

Kato et al.

[11] Patent Number: 4,700,392

[45] Date of Patent: Oct. 13, 1987

[54] SPEECH SIGNAL DETECTOR HAVING ADAPTIVE THRESHOLD VALUES

[75] Inventors: Tadaharu Kato; Takao Nishitani, both of Tokyo, Japan

[73] Assignee: NEC Corporation, Tokyo, Japan

[21] Appl. No.: 643,929

[22] Filed: Aug. 24, 1984

[30] Foreign Application Priority Data

| | | | |
|---|---|---|---|
| Aug. 26, 1983 | [JP] | Japan | 58-156098 |
| May 17, 1984 | [JP] | Japan | 59-99114 |
| May 17, 1984 | [JP] | Japan | 59-99115 |

[51] Int. Cl.[4] ..... G10L 5/00

[52] U.S. Cl. ..... 381/46

[58] Field of Search ..... 381/46, 47; 379/80

[56] References Cited

U.S. PATENT DOCUMENTS

| | | | |
|---|---|---|---|
| 3,832,493 | 8/1974 | Clark | 381/46 |
| 4,000,369 | 12/1976 | Paul et al. | 381/46 |

*Primary Examiner*—E. S. Matt Kemeny

*Attorney, Agent, or Firm*—Sughrue, Mion, Zinn, Macpeak and Seas

[57] ABSTRACT

Speech presence is detected by first comparing input signal absolute value versus a first threshold which is proportional to input signal RMS noise power, accumulating the first comparison output signal, then comparing the accumulated signal versus a second threshold signal which is proportional to a hangover time signal. The first and second threshold signals are used to form up to six threshold values.

6 Claims, 13 Drawing Figures

SPEECH SIGNAL DETECTOR HAVING ADAPTIVE THRESHOLD VALUES

The present invention relates to a speech signal detector for detecting the presence or absence of speech signals.

Speech signal detectors are mainly used, built into digital speech interpolation (DSI) systems, for determining the presence or absence of speech signals. Such speech signal detectors are required to be (1) as promptly responsive to speech signals as possible, (2) as irresponsive to noise as possible and (3) realizable with simple hardware.

An example of this kind of speech signal detector is proposed in the U.S. Pat. No. 4,001,505 issued on Jun. 4, 1977. The speech signal detector described in the patent comprises an amplitude detector section for detecting speech signals having relatively large amplitudes, and a zero crossing density detector section for detecting fricative consonants. Though the speech detector can achieve improvement in speech signal detecting performance, it has such disadvantages as requiring greater hardware and, because of its essentially fixed threshold values, it is apt to malfunction due to D.C. drift contained in input speech signals.

An object of the present invention is to provide a simply structured speech signal detector having threshold values adaptive to the level fluctuations of noise contained in input speech signals.

According to one aspect of the present invention, there is provided a speech signal detector for detecting the presence or absence of speech signals on the basis of level comparison between input signals coming in at every sampling time and threshold values, comprising: an absolute value detector for detecting the absolute value of each of said input signals; a noise power detector for calculating from the output of the absolute value detector the noise power contained in each input signal; a first threshold value setting circuit for generating a first threshold value from the output of the noise power detector; a level detector for comparing the output of said absolute value detector and the threshold value supplied by said first threshold value setting circuit; an accumulating circuit for accumulating the outputs of said level detector; a comparator for comparing the output value of said accumulating circuit and a second threshold value; a hangover timer for giving a hangover time in response to the output of the comparator; and a second threshold value setting circuit for altering said second threshold value in response to the output of the hangover timer and supplying the altered second threshold value to said comparator.

Other features and advantages of the present invention will be more apparent from the detailed description hereunder taken in conjunction with the accompanying drawings, wherein.

Figure 1:
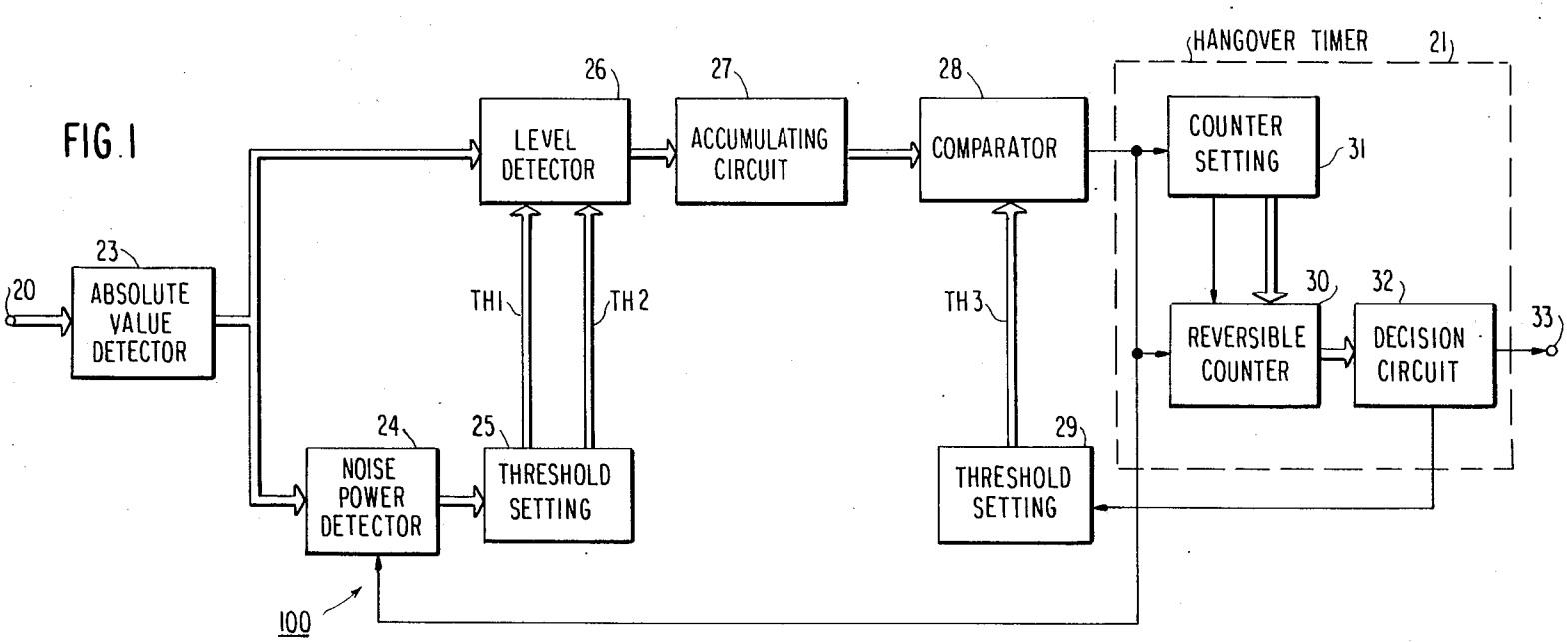
FIG. 1 is a block diagram showing first preferred embodiment of the invention.

In the drawings, the same reference numerals represent respectively the same structural elements, and on thick lines signals are supplied in parallel in the form of plural bits while on thin solid lines they are supplied bit by bit in series. The means for supplying clock pulses and those for supplying electric power to the illustrated structural elements are dispensed with in the drawings for the sake of simplicity.

Referring to FIG. 1, a speech signal detector 100 of the invention comprises an absolute value detector 23, a noise power detector 24, a first threshold setting circuit (referred to TSC) 25, a level detector 26, an accumulating circuit 27, a comparator 28, a second TSC29, and a hangover timer 21. To an input terminal 20 is supplied an input speech signal of pulse code-modulated (PCM) eight-bit code words. The absolute value detector 23 converts these input signals into absolute value signals (signals representing only the magnitude), and supplies the absolute value signals to the noise power detector 24 and the level detector 26.

The noise power detector 24 calculates the average power of the noise contained in the input signal, and supplies the calculated result to the first TSC25. By multiplying the noise power by a fixed number, the first TSC25 produces first and second threshold values, respectively TH1 and TH2, to be used by the level detector 26.

With the absolute value greater than the second threshold value TH2, the level detector 26 produces +3 (represented in decimal notation), which shows that the input signal is more likely to be a speech signal. Hereinafter, the value having a sign (+) or (−) denotes the one represented in decimal notation and the value having a quotation mark " " denotes the one represented in binary notation. When the absolute value lies between the first and second threshold values TH1 and TH2, the detector 26 produces +1, which shows that the probability of the input signal is to be a speech signal is either virtually equal to or only slightly greater than the probability to be noise. With the absolute value less than the first threshold value TH1, the detector 26 produces −1, which indicates that the input signal is more likely to be noise. The accumulating circuit 27 accumulates the output of the level detector 26 to supply to the comparator 28. When the accumulated value exceeds a third threshold value TH3 supplied from the second TSC29, the comparator judges that the input signal is a speech signal by producing "1". When the third threshold value TH3 is greater than the accumulated value, the input signal is judged to be noise, and "0" is produced. The second TSC29 generates a higher threshold value TH3H or lower threshold value TH3L in response to the output "0" or "1" of the decision circuit 32. In response to the output "1" of the comparator 28, a hangover timer 21 produces "1" by way of the output terminal 33. The timer 21 also adds a hangover time by maintaining the output "1" for a predetermined duration at the time when the output of comparator 28 changes from "1" to "0". Of course when the output of the comparator 28 is "0" and therefore no speech signal has been detected, "0" will appear at the output terminal 33.

The hangover timer 21 comprises a counter setting circuit 31, a decision circuit 32 and a reversible counter 30. With the change in the comparator output from "1"

to "0", if the content of the reversible counter 30 exeeds a fourth threshold value TH4, the setting circuit 31 sets the content of the reversible counter 30 at a longer hangover time. Meanwhile, with the counter output less than the threshold value TH4, the setting circuit 31 gives the counter 30 a shorter hangover time. The decision circuit 32, in response to the reversible counter output greater than a fifth threshold value TH5, produces "1", which indicates the detection of a speech signal.

Figure 2:
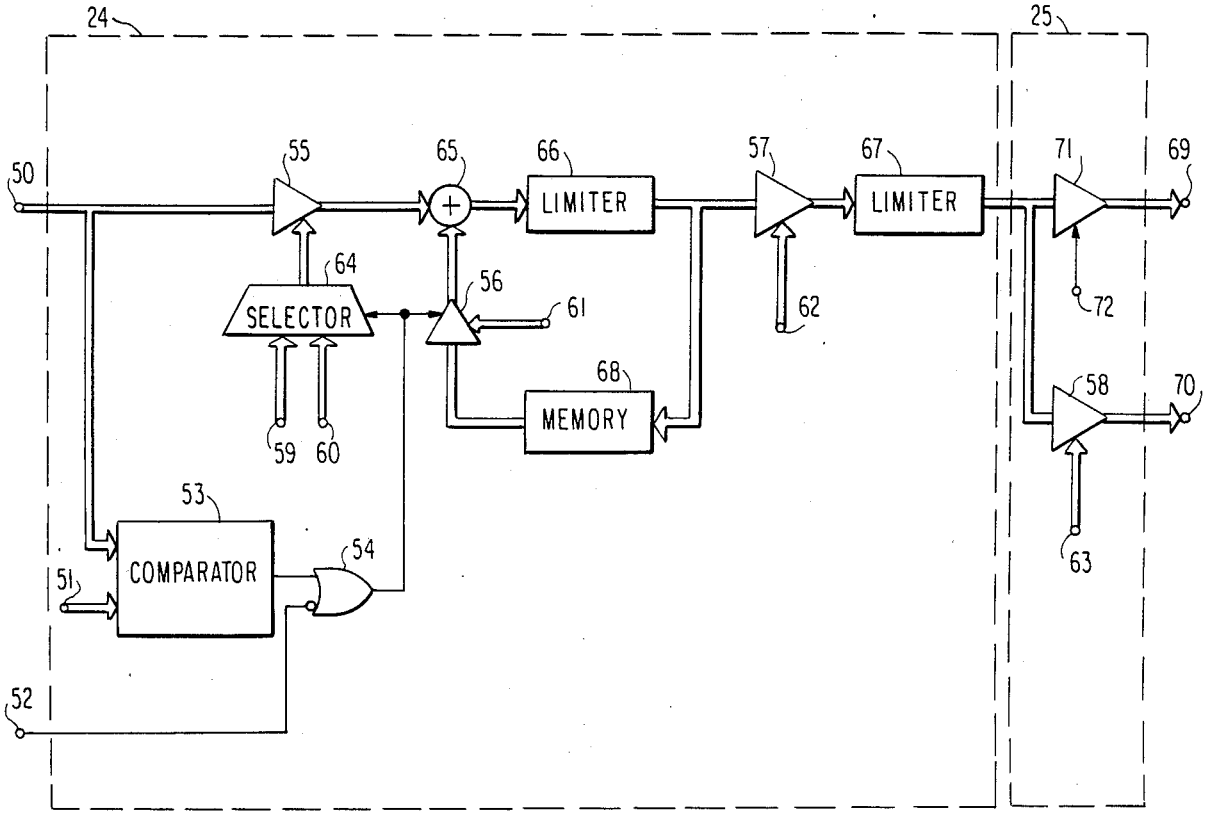

Referring now to FIG. 2, in the noise power detector 24, an absolute value signal fed to a terminal 50 is supplied to a multiplier 55 and a comparator 53. The comparator 53 produces "0" when the absolute value signal is greater than a noise evaluation level given from a terminal 51, or produces "1" when it is below. An OR gate 54 takes the logical sum of the output of the comparator 53 and a signal resulting from reversal of the output given from the comparator 28, and produces "1" when at least one of those signals is "1". The OR gate 54 supplies its output to a multiplier 56 as a control signal and to a selector 64 as a selection control signal. The selector 64 selects a coefficient from a terminal 59 or another coefficient from a terminal 60 on the basis of the selection control signal "1" or "0". The multiplier 55 performs the multiplication of the absolute value signal and a coefficient selected. Meanwhile, the multiplier 56 multiplies a coefficient from a terminal 61 and the content of a memory 68. However, with the output "0" of the OR circuit 54, no multiplication operation is done in the multiplier 56 but the content of the memory 68 is supplied as it is. The adder 65 adds the outputs of the multiplier 55 and 56, and feeds the sum to the memory 68 by way of a limiter 66.

It should be noted that the adder 65, limiter 66, memory 68 and multiplier 56 constitute a low-pass filter. The output of the limiter 66 and a coefficient from a terminal 62 are multiplied by a multiplier 57 so that the resultant product is supplied to a limiter 67. The output of the limiter 67 is multiplied with coefficients from terminals 63 and 72 in multipliers 58 and 71 to produce the first and second threshold values TH1 and TH2.

The limiters 66 and 67 are used here to accelerate the adjusting speed by restricting the content of the memory 68 and the value of the threshold value TH1 and to limit the reception sensitivity of the speech signal detector.

Figure 3:
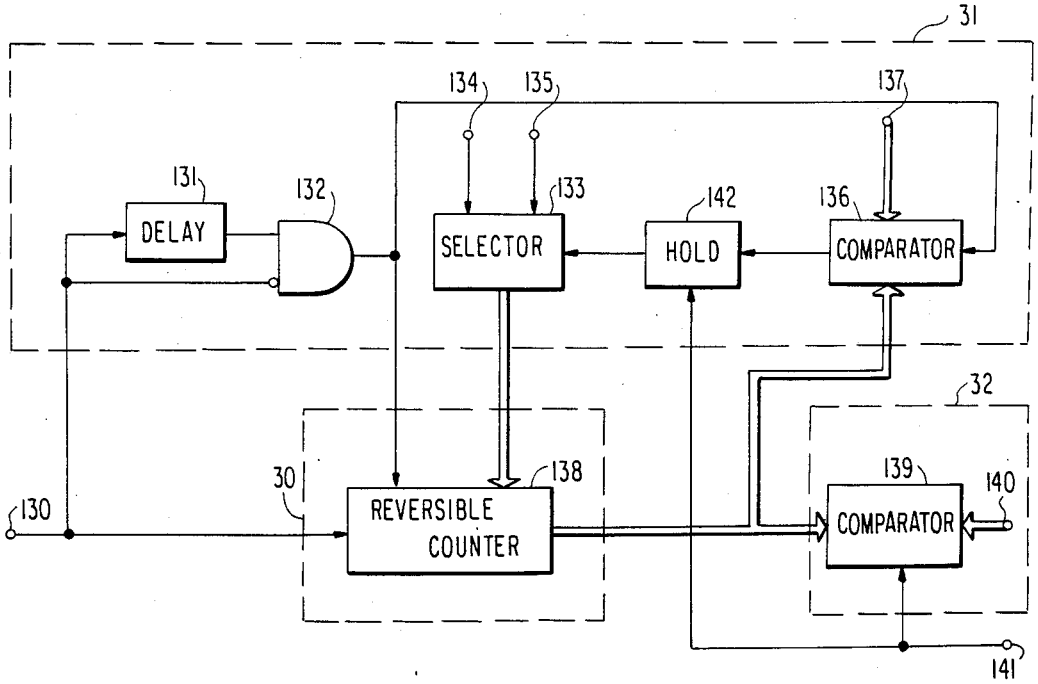

Referring to FIG. 3, in the counter setting circuit 31, the output of the comparator circuit 28 given from a terminal 130 is supplied to a delay circuit 131 and an AND gate 132. The AND gate 132 takes the logical product of a signal resulting from reversal of the current input signal and an input signal of one sample time before, and feeds it to the reversible counter 138 and a first comparator 136. Upon the output "1" of the AND gate 132, if the content of the reversible counter 138 is greater than the fourth threshold value TH4 from a terminal 137, the comparator 136 produces "1" to set a longer hangover time. Meanwhile, if the content of the reversible counter 138 is smaller than the threshold value TH4, the comparator 136 produces "0" to set a shorter hangover time. A selector circuit 133 selects a longer hangover time from a terminal 134 or a shorter hangover time from another terminal 135 in response to the output "1" or "0" of a hangover hold circuit 142.

The hangover hold circuit 142, in response to the output "1" of the first comparator 136, holds that value as long as the output of the decision circuit 32 is "1".

The reversible counter 138 increases or decreases its content by 1, in response to "1" or "0" of the input signal from the terminal 130. When the AND circuit 132 produces "1", the content of the counter 138 is forcibly set at a value supplied from the selector 133. Upon the content of the reversible counter 138 greater than the fifth threshold value TH5 from a terminal 140, a second comparator 139 produces "1" by way of an output terminal 141.

Figure 4:
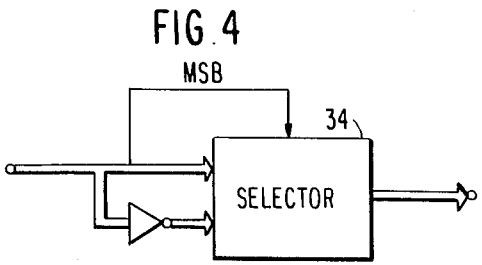

Referring now to FIG. 4, the absolute value detector circuit comprises a selector 34 for selecting either an input signal itself or a signal resulting from reversal of the input signal according to the value of the most significant bit of the input signal.

Figure 5:
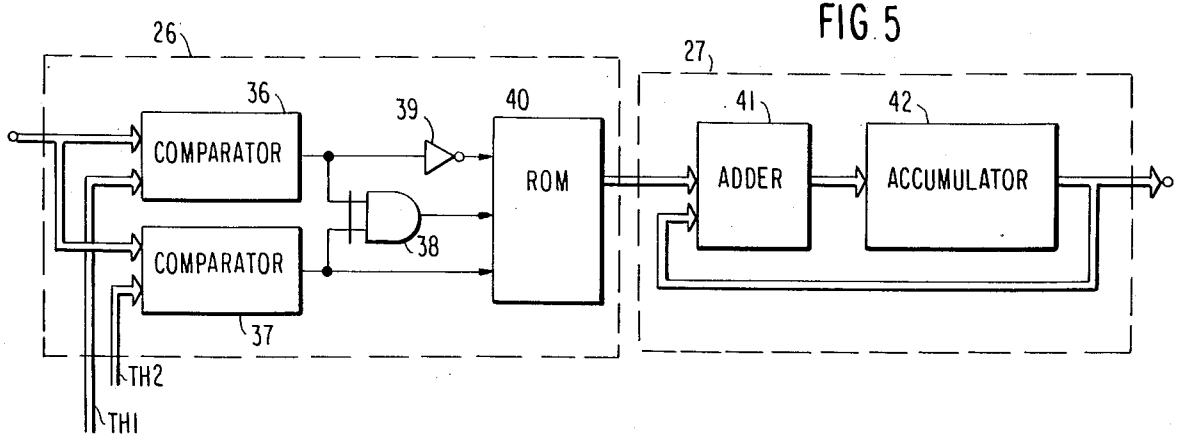
FIGS. 2 to 5 are circuit diagrams of one or another part of the embodiment of FIG. 1.

With reference to FIG. 5, the level detector 26 comprises comparators 36 and 37 for comparing the input signal with the threshold values TH1 and TH2, respectively, an exclusive OR gate 38, an inverter 39 and a read only memory (ROM) 40. The ROM 40 produces $-1$ (decimal) if the absolute value $|X|$ is smaller than TH1, $+1$ if it is greater than the value TH1 but smaller than TH2, or $+3$ if it is greater than the value TH2. The accumulating circuit 27 has an adder 41 for adding the output of the level detector circuit 26 and that of an accumulator 42. The adder 41 performs the addition of $-1$ as well as that of $+3$ or $+1$. Now assuming that the output of the accumulator 42 is "00011" and the ROM 40 outputs its maximum value "11111" (if it is in five bits) corresponding to $-1$, the adder 41 gives "00010" by adding "11111" and "00011". The result "00010" is equal to the result obtained by subtracting "00011" from "00001". This means the adder 41 performs the addition of $-1$.

Figure 6A:
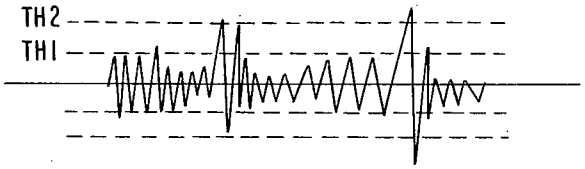
FIGS. 6A and 6B are diagrams for describing the method to set threshold values.
Figure 6B:
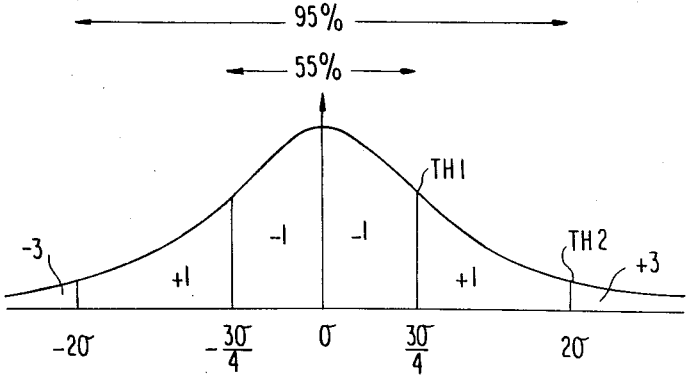

Next will be explained the first and second threshold values TH1 and TH2, respectively, and the output values ($+3$, $+1$, $-1$) of the level detector circuit 26. Supposing now that the noise shown in FIG. 6A is in Gaussian distribution, such noise is well known to be in normalized distribution as shown in FIG. 6B, where the root mean square value $\sigma$ of the noise is plotted on the axis of abscissa and the probability distribution of the noise, on the axis of ordinate. According to FIG. 6B, a 5% segment of the noise has a level greater than the level of $2\sigma$, and another 55% segment has a level equal to $\frac{3}{4}$ of the value $\sigma$. Therefore, if the first and second threshold values TH1 and TH2 are set at $\frac{3}{4}\sigma$, and $2\sigma$, respectively, and the level detector 26 produces $+3$ when the input signal surpasses the threshold value TH2, $+1$ when it is between the threshold values TH1 and TH2 or $-1$ when it is below the threshold value TH1, then the accumulated value En of the noise in the accumulating circuit 27 can be reduced to 0 in the following way:

$$En = 3 \times \frac{5}{100} + 1 \times \left(\frac{95}{100} - \frac{55}{100}\right) + (-1) \times \frac{55}{100} = 0$$

This indicates that, in a section where speech signals are absent, the detector 100 will not malfunction.

Now will be described the operation of the speech signal detector shown in FIG. 1 with reference to FIGS. 7A to 7D.

Figure 7A:
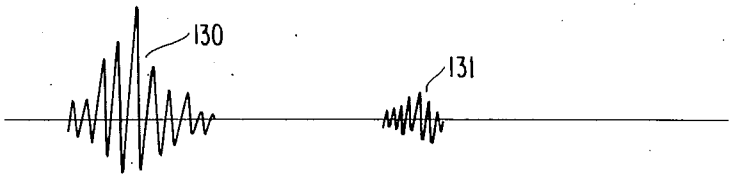
FIGS. 7A to 7D are diagrams for describing the operation of the embodiment of FIG. 1.
Figure 7B:
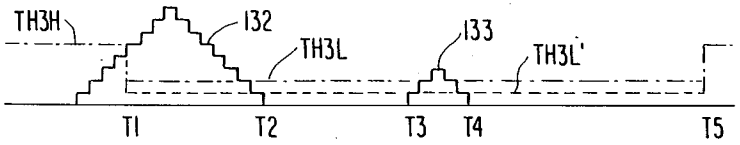
Figure 7C:
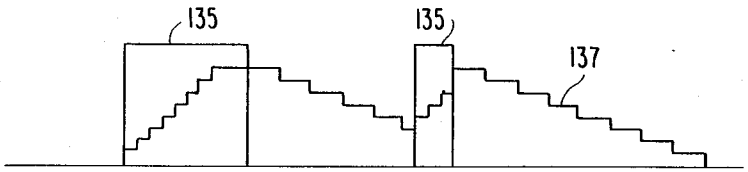
Figure 7D:
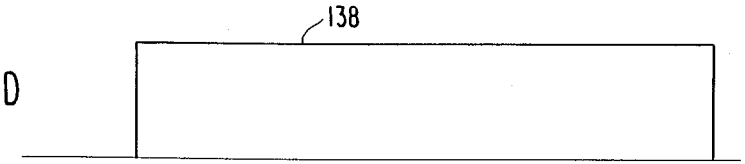

Suppose that speech signals 130 and 131 shown in FIG. 7A are supplied to the detector. The speech signal 130 is compared in the level detector circuit 26 with the first and second threshold values TH1 and TH2, respectively, and a signal 132 shown in FIG. 7B is provided as the output of the accumulating circuit 27. The comparator 28 compares the output signal 132 of the accumulating circuit 27 with the third threshold value TH3H. Until a point of time T1, no speech signal is detected because the third threshold value TH3H is greater than the output signal 132 of the accumulating circuit 27. However, as the latter becomes greater than the former at the point of time T1, the output 135 of the comparator 28 turns "1", and the output 137 (FIG. 7C) of the reversible counter 30 also begins to increase. Therefore, the output signal 138 (FIG. 7D) of the output terminal 33 also turns "1", which means the detection of a speech signal.

While the higher third threshold value TH3H has been selected until the point of time T1 due to the output "0" of the output terminal 33, after that time T1, the lower third threshold value TH3L is selected in response to the output "1" of the output terminal 33.

Afterwards, as the amplitude of the speech signal 130 decreases and at a point of time T2 the output 132 of the accumulating circuit 27 becomes smaller than the third threshold value TH3L, the output 135 (FIG. 7C) of the comparator 28 turns "0". However, as a hangover time is set, the output 137 of the reversible counter 30 does not immediately turn to "0".

If the speech signal 131 (FIG. 7A) arrives at the input terminal 20 when a hangover time is added in this way, the output 133 of the accumulating circuit 27 becomes greater than the third threshold value TH3L at a point of time T3. As a result, the output 135 of the comparator 28 again turns "1", and the content 137 of the output of the reversible counter 30 again begins to increase. At a point of time T4, as the output 133 of the accumulating circuit 27 becomes smaller than the lower third threshold value TH3L, the output 135 of the comparator circuit 28 again turns "0". This causes, as stated above, data for hangover to be set in the reversible counter 30 so that a hangover time is added.

As the hangover comes to an end at a point of time T5, the output 138 of the output terminal 33 turns "0", and the higher level third threshold value TH3H is again selected.

By selectively using two different third threshold values TH3H and TH3L according to the output of the terminal 33, it is made possible to detect even low-level speech signals (for instance the signal 131 of FIG. 7A) in sound-present periods and thereby to reduce omissions in speech and the clipping of word endings.

Figure 8:
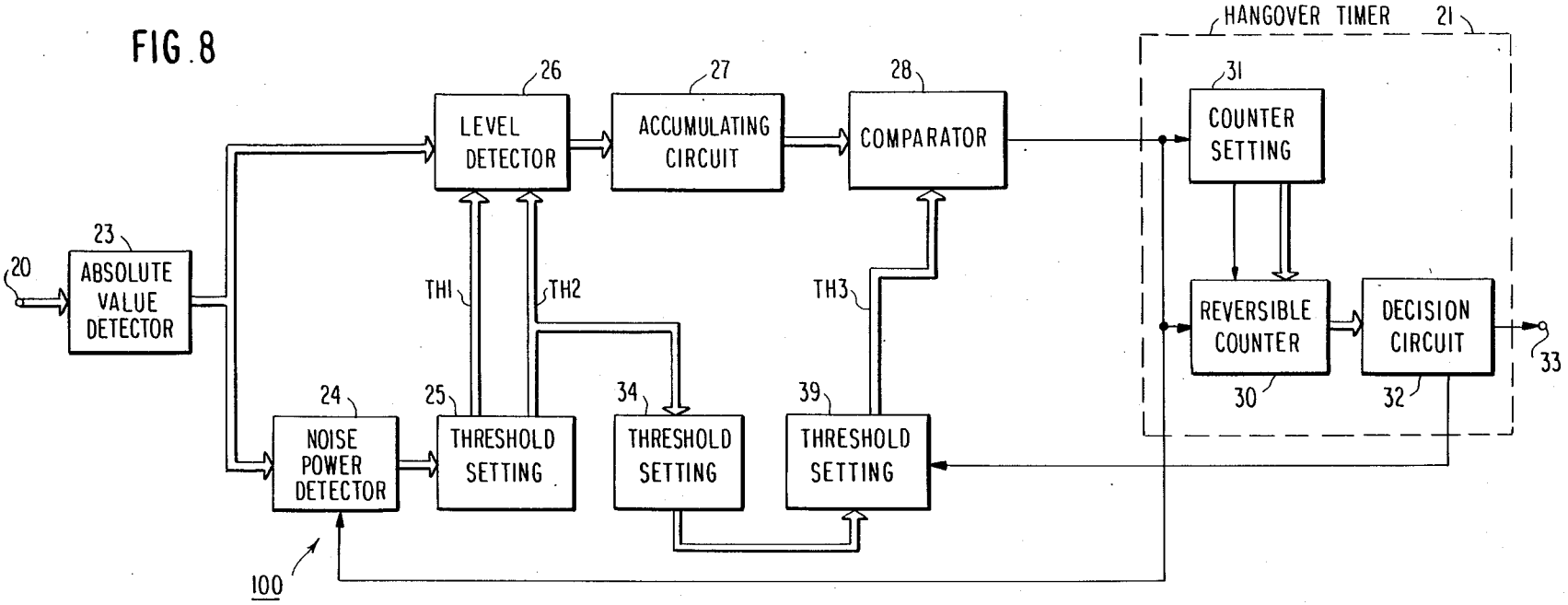
FIG. 8 is a block diagram showing a second embodiment of the invention.

Referring now to FIG. 8, in a second preferred embodiment of the present invention, a detector 200 is structured by adding a selector 34 to the detector 100 of FIG. 1. This selector circuit 34 selects one out of a predetermined plurality of low-level threshold values according to the second threshold value TH2, and supplies the value so selected to the second threshold setting circuit 29. Such a selector 34 may be composed of a read only memory (ROM) which produces a third threshold value TH3L with the second threshold value TH2 given as its address.

Figure 9:
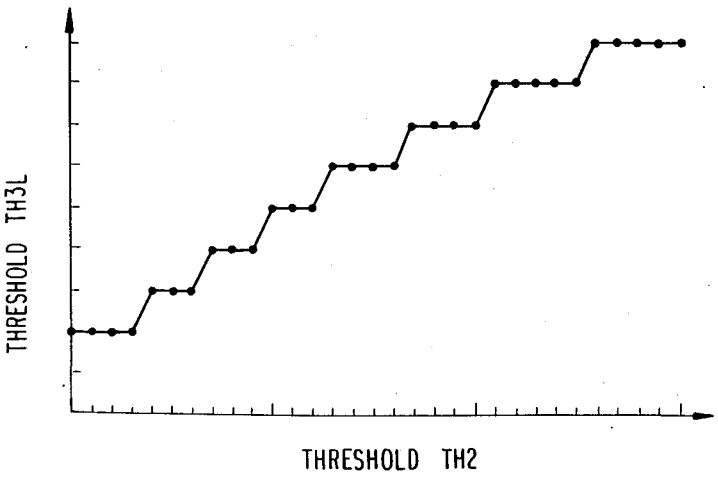
FIG. 9 is a diagram showing the relationship between a threshold value TH2 and another threshold value TH3L.

FIG. 9 illustrates the relationship between the threshold values TH2 and TH3L. The smaller the second threshold value TH2, the smaller is the third threshold value TH3L, because the lower the noise level, the smaller the accumulated value averaged over time. Thus, by making the threshold value TH3L variable according to the noise level (like TH3L in FIG. 7B for instance), it is made possible to reduce noise-caused malfunction which arises when a hangover is added and, accordingly, omissions in speech and the clipping of word endings.

Although long and short hangover times are used in the foregoing embodiments, when a single fixed hangover time is to be set, it can be realized by eliminating the comparator 136, the hangover hold circuit 142 and the selector circuit 133 from the circuitry of FIG. 3, and supplying the fixed hangover time to the reversible counter 30.

Further, though the output of the comparator 28 is employed therein as the noise determination signal to be used in the calculation of noise power, the same effect can be achieved if the output of the decision circuit 32 is used instead.

As stated above, the speech signal detector having adaptive threshold values according to the invention provides the following advantages:

(1) The detector is invulnerable to noise because its first and second threshold values are varied adaptively to the noise level;

(2) The reception sensitivity can be set as desired by determining the maximum and minimum of the threshold values; and (3) By the use of third threshold values of different levels, it is made possible to steadily achieve satisfactory speech signal detecting performance independently of the noise level.

What is claimed is:

1. A speech signal detector for detecting the presence or absence of speech signals on the basis of level comparison between input signals coming in at every sampling time and threshold values, comprising: an absolute value detector for detecting the absolute value of each of said input signals; a noise power detector for calculating from the output of said absolute value detector the noise power contained in each input signal; a first threshold value setting circuit for generating a first threshold value from the output of said noise power detector circuit; a level detector for comparing the output of said absolute value detector and the threshold value supplied by said first threshold value setting circuit; an accumulating circuit for accumulating the outputs of said level detector; a comparator for comparing the output value of said accumulating circuit and a second threshold value; a hangover timer for giving a hangover time in response to the output of this comparator; and a second threshold value setting circuit for altering said second threshold value in response to the output of this hangover timer and supplying the altered second threshold value to said comparator.

2. A speech signal detector as claimed in claim 1, wherein said first threshold setting circuit comprises means for generating a third threshold value and means for generating a fourth threshold value, and said level detector circuit comprises means for producing +3 when said input signal is greater than said fourth threshold value, +1 when said input signal is between said third and fourth threshold values, and −1 when said input signal is smaller than said third threshold value.

3. A speech signal detector as claimed in claim 2, wherein said third and fourth threshold values are set at $\frac{3}{4}$ and a twofold, respectively, of the root mean square value of said noise.

4. A speech signal detector as claimed in claim 1, wherein said hangover timer comprises a reversible counter for counting up or down according to the output of said comparator and a decision circuit for deciding the presence or absence of speech signals according to the content of said reversible counter.

5. A speech signal detector as claimed in claim 1 or 4, wherein said second threshold setting circuit comprises means for generating fifth and sixth threshold values and a selector for selecting one or the other of these fifth and sixth threshold values in response to the output of said decision circuit.

6. A speech signal detector as claimed in claim 5, wherein said fifth threshold setting circuit comprises a read only memory for generating said fifth threshold value corresponding to said third threshold value.

* * * * *